US007392913B2

(12) United States Patent
McGlynn et al.

(10) Patent No.: US 7,392,913 B2
(45) Date of Patent: Jul. 1, 2008

(54) SELF-ADJUSTING VOLUME DISPLAY AND MERCHANDISE DISPENSING SYSTEM

(76) Inventors: Michael McGlynn, 413 Horizon Dr., Edison, NJ (US) 08817; William J. Casero, 500 E. Clay Ave., Roselle Park, NJ (US) 07204

( * ) Notice: Subject to any disclaimer, the term of this patent is extended or adjusted under 35 U.S.C. 154(b) by 0 days.

(21) Appl. No.: 10/724,479

(22) Filed: Dec. 1, 2003

(65) Prior Publication Data

US 2004/0118799 A1 Jun. 24, 2004

Related U.S. Application Data

(60) Provisional application No. 60/433,188, filed on Dec. 13, 2002.

(51) Int. Cl.
*A47J 47/00* (2006.01)

(52) U.S. Cl. ..... 211/126.1

(58) Field of Classification Search ..... 211/126.1, 211/72, 73, 119.003, 187, 133.1, 59.2, 85.26
See application file for complete search history.

(56) References Cited

U.S. PATENT DOCUMENTS

| | | | | | |
|---|---|---|---|---|---|
| 1,752,369 | A | * | 4/1930 | Chapman | 211/126.14 |
| 1,776,071 | A | * | 9/1930 | Horwath | 108/157.16 |
| 2,104,523 | A | * | 1/1938 | Lichtenstein | 221/197 |
| 2,145,563 | A | | 1/1939 | Watson | |
| 2,797,815 | A | * | 7/1957 | Gorman | 211/72 |
| 2,922,552 | A | * | 1/1960 | Berger et al. | 222/185.1 |
| 3,900,112 | A | | 8/1975 | Azzi et al. | |
| 4,369,887 | A | | 1/1983 | Emery | |

(Continued)

*Primary Examiner*—Sarah Purol
(74) *Attorney, Agent, or Firm*—Arthur M. Peslak

(57) ABSTRACT

An upstanding Self-Adjusting Volume Display and Merchandise Dispensing System designed to increase merchandise and order picking dispensing efficiency and solve major space problems in a direct marketing distribution facility and other product display situations. The inventive system includes a main high-volume, open-top storage bin or hopper with an inclined floor member slanting toward the front of the hopper and a companion, upstanding, telescoping, self-adjusting volume chute vertically and slidably engaged within the interior of the main hopper. The main hopper has a discharge opening at the bottom of the front panel in which a picking portal is inserted, allowing merchandise filled therein to slide forward to be extracted therefrom.

Attached to the upper front panel of the main hopper, by way of an attachment hook assembly, is an optional removable, open-top, upstanding, low-volume, merchandise hopper vertically stacked directly on top of the picking portal that is slidably engaged within the opening in the lower front panel of the main hopper such that it protrudes out of the front panel of the main hopper. This configuration of low-volume hoppers attached to the main hopper can be repeated again and again creating a nest of multiple, vertically stacked openings for dispensing and extracting merchandise. Each additional low-volume merchandise hopper attached to a main hopper is fitted with a picking portal, allowing each of the many vertically stacked discharge openings to be in the same frontal plane. Also, each additional discharge opening or picking portal adds an additional product to the mix of merchandise available at the multitude of openings for extracting merchandise. High and low-volume hoppers can also be placed side-by-side such as to add even more openings to dispense merchandise. Increasing the number of hoppers in a horizontal plane insures the likelihood that the merchandise extraction openings will remain at a convenient, reachable level.

12 Claims, 16 Drawing Sheets

U.S. PATENT DOCUMENTS

| | | | |
|---|---|---|---|
| 4,453,641 | A | 6/1984 | Rasmussen et al. |
| 4,790,707 | A | 12/1988 | Magretta et al. |
| 5,115,920 | A | 5/1992 | Tipton et al. |
| 5,395,206 | A | 3/1995 | Cerny |
| 5,482,423 | A | 1/1996 | Tawara |
| 5,628,613 | A | 5/1997 | Tawara |
| 6,267,258 | B1 | 7/2001 | Wilkerson et al. |

* cited by examiner

SELF-ADJUSTING VOLUME DISPLAY AND MERCHANDISE DISPENSING SYSTEM

PRIORITY

This application claims priority to U.S. Provisional Application No. 60/433,188 filed Dec. 13, 2002.

BACKGROUND OF THE INVENTION

The present invention will now be described in the context of a presently contemplated embodiment as illustrated in the drawings. However, the appended claims should not be construed as limited to the disclosed embodiments.

The present invention is directed to a device and method for storage and dispensing of items. It is presently contemplated that one application of the present invention is in a warehouse where mail order items are stored in the devices of the present invention and dispensed to employees who pack orders for shipment to the customers. However, it is also presently contemplated that the system and method can be applied to other applications such as retail locations and others.

It can be appreciated that stock and merchandise dispensers of various configurations have been in use for years. Typically, these dispensers are constructed in a flow rack or a static rack configuration that accept shipping boxes and cartons as the dispensing reservoir.

The primary deficiencies with available storage and dispensing devices and methods are that they are costly to purchase, occupy an enormous amount of floor space, require frequent replenishing, sometimes require the use of ladders to reach merchandise, restocking interferes with the removal of merchandise from the discharge openings or the order picking process, along with creating major traffic congestion from discarded empty boxes and cartons during restocking. Other problems with conventional dispensers concern difficulty in reaching some of the merchandise on the racks and the fact that individuals removing merchandise must travel many more steps due to the enormous floor space required for conventional dispensers. Still another problem with conventional merchandise dispensers is the fact that unloading merchandise from within the main hopper for inventory purposes is very time-consuming. While in the past, people have accepted the deficiencies in these conventional merchandise dispensers, they are not suitable for efficiently dispensing high-volumes of merchandise in an efficient manner at a low cost nor is the dispensing system so designed to occupy a minimum of floor space. This prevents the owner of such a dispensing system from being able to expand to a greater number of picking stations without requiring additional floor space.

In this respect, the Self-Adjusting Volume Display and Merchandise Dispensing System, of the present invention, substantially departs from the conventional concepts and designs of available systems, and in so doing provides an apparatus primarily developed for the purpose of rapid response manual order picking not seen in available systems.

SUMMARY OF THE INVENTION

In view of the disadvantages inherent in presently available merchandise dispensing systems such as flow rack and static rack systems, the present invention provides a new easily replicable construction that can be utilized to provide a more efficient, more economical, gravity fed, automatically replenished dispensing system in the form of an upstanding, rectangular, box shaped container or supply hopper for more efficient dispensing of varying types of merchandise. Individuals access the dispensing system by way of a series of vertically stacked and horizontally placed openings or picking portals. Each such portal dispenses or displays a different type of merchandise. This new construction gives the individuals removing merchandise from the picking portals a greater volume and variety of easily reachable merchandise than any manual system currently available. The present invention also provides for greater space savings and less travel by the individuals removing the merchandise from the discharge openings by taking advantage of unused vertical space above the dispensing system, not commonly used by other merchandise and dispensing systems.

The general purpose of the present invention, which will be described subsequently in greater detail, is to provide a unique, merchandise dispensing system for order picking or display. However, the present invention is not limited to such configurations, but has many of the advantages of the systems mentioned in prior art and many more novel features that result in a new dispensing system that is not anticipated, rendered obvious, suggested, or even implied by any of the previously conceived dispensing systems, alone or in combination.

To attain this unique dispensing system, the present invention generally comprises a high-volume, upstanding main storage and dispensing hopper, and additional stacked and side-by-side low-volume attachments, similar in design and construction, that deliver more picking portals of easily reachable volumes of merchandise than inventions shown and discussed in prior art. The main open top, high-volume hopper has an additional open top, self-adjusting chute that is slidably engaged within the inner walls, allowing an increased volume of product to be loaded without the need for frequent replenishment.

There has thus been outlined, rather broadly, some important features of the present invention in order that the detailed description thereof may be better understood and in order that the present contribution to the art may be better appreciated. There are additional features of the invention that will be described hereinafter.

In this respect, before explaining the embodiments of the present invention in detail, it is to be understood that the invention is not limited in its application to the details of construction and to the arrangements of the components set forth in the following description or illustrated in the drawings. Those of ordinary skill in the art will recognize that the present invention is capable of other embodiments and of being practiced and carried out in various other ways. Also, it is to be understood that the phraseology and terminology employed herein are for the purpose of the description and should not be regarded as limiting.

A primary object of the present invention is to provide an inexpensive Self-Adjusting Volume Display and Merchandise Dispensing System that will overcome the deficiencies of the presently available devices.

Another object of the present invention is to provide a Self-Adjusting Volume Display and Merchandise Dispensing System that allows an individual convenient, easy, and reachable access to a large variety of stored products through a multitude of vertically stacked and side-by-side portals containing products.

Another object is to provide a Self-Adjusting Volume Display and Merchandise Dispensing System that reduces the number of steps each picker must take in order to fulfill an order.

Another object is to provide a Self-Adjusting Volume Display and Merchandise Dispensing System that measurably reduces the floor space necessary to house the system.

Another object is to provide a Self-Adjusting Volume Display and Merchandise Dispensing System that costs less than prior art systems involving flow racks, static racks and other dispensing and picking systems.

Another object is to provide a Self-Adjusting Volume Display and Merchandise Dispensing System that is lightweight, easily installed, durable, and quickly collapsible for comparably lower cost and manpower requirements.

Another object is to provide a Self-Adjusting Volume Display and Merchandise Dispensing System that provides a multitude of vertically stacked and side-by-side, easily reachable openings or picking portals from which to retrieve a variety of merchandise.

Another object is to provide a Self-Adjusting Volume Display and Merchandise Dispensing System that has an upstanding, telescoping, slidable insert that accommodates increased product volume without the requirement of additional floor space or racking as compared with other prior art systems.

Another object is to provide a Self-Adjusting Volume Display and Merchandise Dispensing System that allows easy and convenient visual observation of the need to replenish the hopper with merchandise without observing the contents therein.

Another object is to provide a Self-Adjusting Volume Display and Merchandise Dispensing System that can easily, inexpensively, and quickly be co-mingled or coupled with or converted from existing static rack or flow rack systems.

Another object is to provide a Self-Adjusting Volume Display and Merchandise Dispensing System constructed in such a manner as to prevent products from inadvertent dropping to the floor from the picking portals.

Another object is to provide a Self-Adjusting Volume Display and Merchandise Dispensing System that does not interfere with the normal replenishing operation by causing congestion and traffic in the picking area.

Another object is to provide a Self-Adjusting Volume Display and Merchandise Dispensing System that delivers more easily reachable product volume than prior art systems.

Another object is to provide a Self-Adjusting Volume Display and Merchandise Dispensing System that reduces the number of reserve bulk pick tickets necessary to complete the replenishment of the forward picking area, when used by order pickers.

Other objects and advantages of the present invention will become obvious to those of ordinary skill in the art. It is intended that these obvious objects and advantages be within the scope of the present invention.

To the accomplishment of the above and related objects, this invention may be embodied in the form illustrated in the accompanying drawings. Attention is called to the fact that the drawings are illustrative only and that changes may be made in the specific construction illustrated.

DETAILED DESCRIPTION OF THE INVENTION

Turning now descriptively to the drawings, in which similar reference numbers denote similar elements throughout the several views, the attached figures illustrate a Self-Adjusting Volume Display and Merchandise Dispensing System for the storage and dispensing of merchandise. The system comprises an open top main hopper and similarly constructed attachments thereto providing a multitude of stacked and horizontally disposed discharge openings or picking portals. The main hopper, a rectangular box shaped configuration, and associated attached hoppers, similar in construction, for ease of assembly, weight and cost reduction, and portability, can be fabricated from durable cardboard or other light, flexible materials such as plastic. The main hopper has an upright, slidably engaged inner sleeve that travels in a manner collinear to the inner walls of the main hopper. It is constructed to self-adjust by physically monitoring the tangential and associated friction forces between the Main Hopper assembly and the Self-Adjusting Volume Control Assembly generated by the weight of the merchandise stored therein on the walls of the hopper. The bottoms of the main hopper and the attached associated hoppers have inside wedges forwardly inclined toward the front of the Main Hopper Assembly that terminate at the bottoms of the hoppers causing the merchandise to gravitate toward the front of the main hoppers to the discharge openings. The main hopper has a removable discharge portal extending outward from the front of the main hopper and serving as a base upon which an associated low-volume hopper rests. Each associated low-volume hopper has a static, non-removable discharge opening. Each discharge opening has an upstanding baffle located at the bottom front portion of the discharge opening to prevent merchandise from spilling to the floor once it has been urged forward by the wedge. When merchandise is withdrawn from the discharge opening of the hoppers, other merchandise will be urged forward in the hoppers by their respective wedges to replace that which has been removed.

The Self-Adjusting Volume Display and Merchandise Dispensing System is comprised of several components, the least of which are:

Main Hopper Assembly 100
Self-Adjusting Volume Control Hopper Assembly 120
Main Hopper Attachment Assembly 160
Picking Portal Assembly 130
Main Hopper Liner Assembly 110
Rail Assembly 170
Inside Wedge Assembly 140
Hanger Assembly 150

Figure 4:
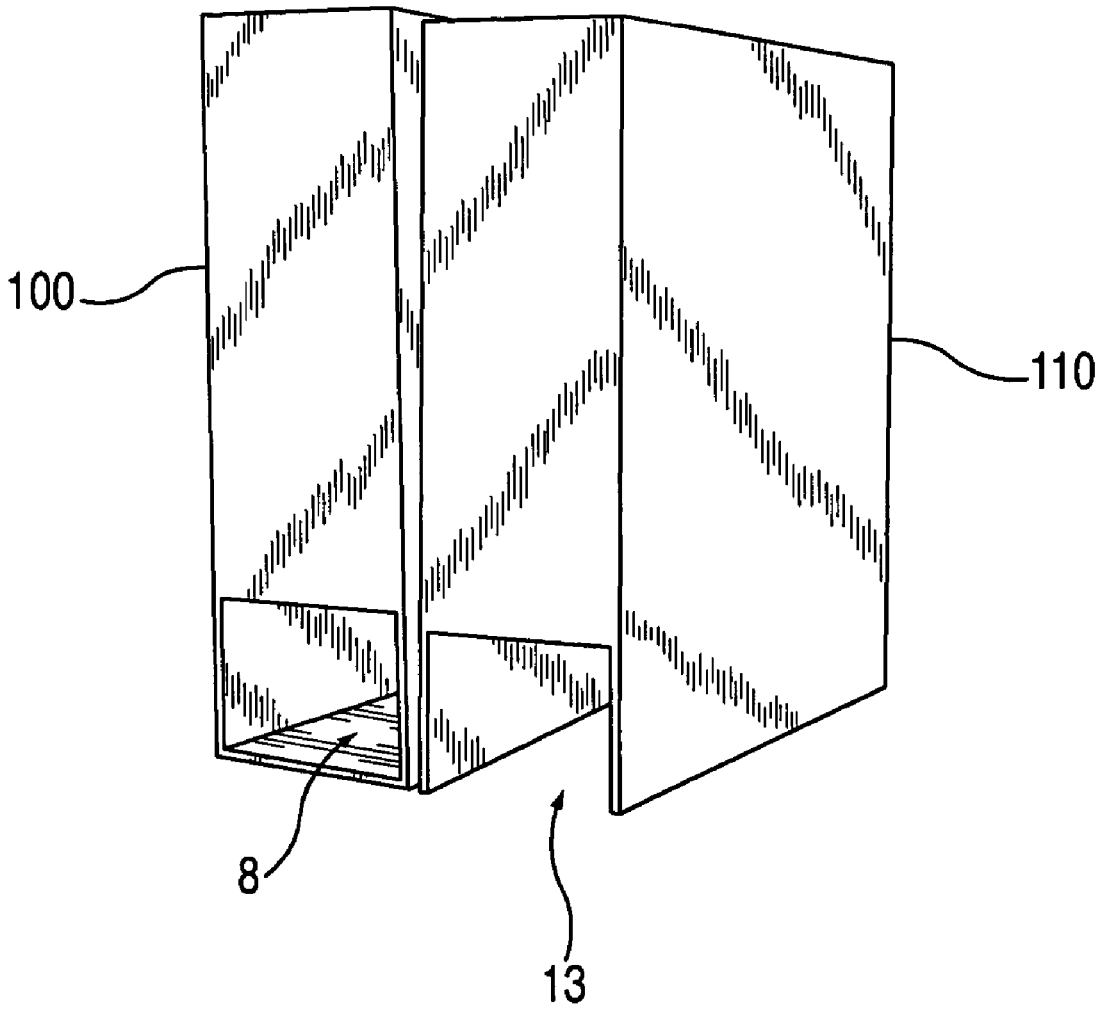
FIG. 4 is a view in perspective of a Main Hopper Assembly and a Main Hopper Assembly Liner.
Figure 4A:
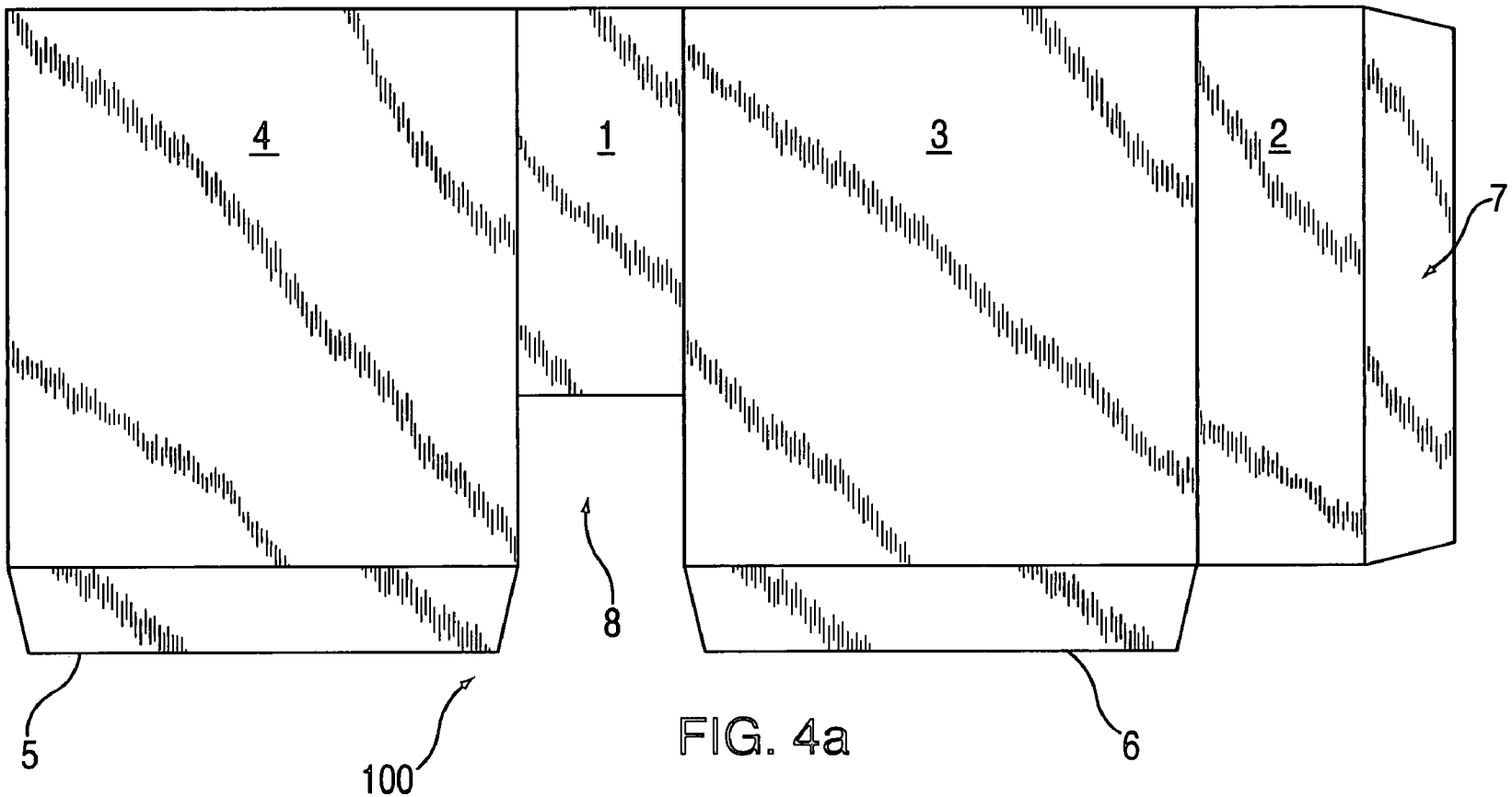
FIG. 4*a* shows the assembly layout blank from which the Main Hopper is made.
Figure 7:
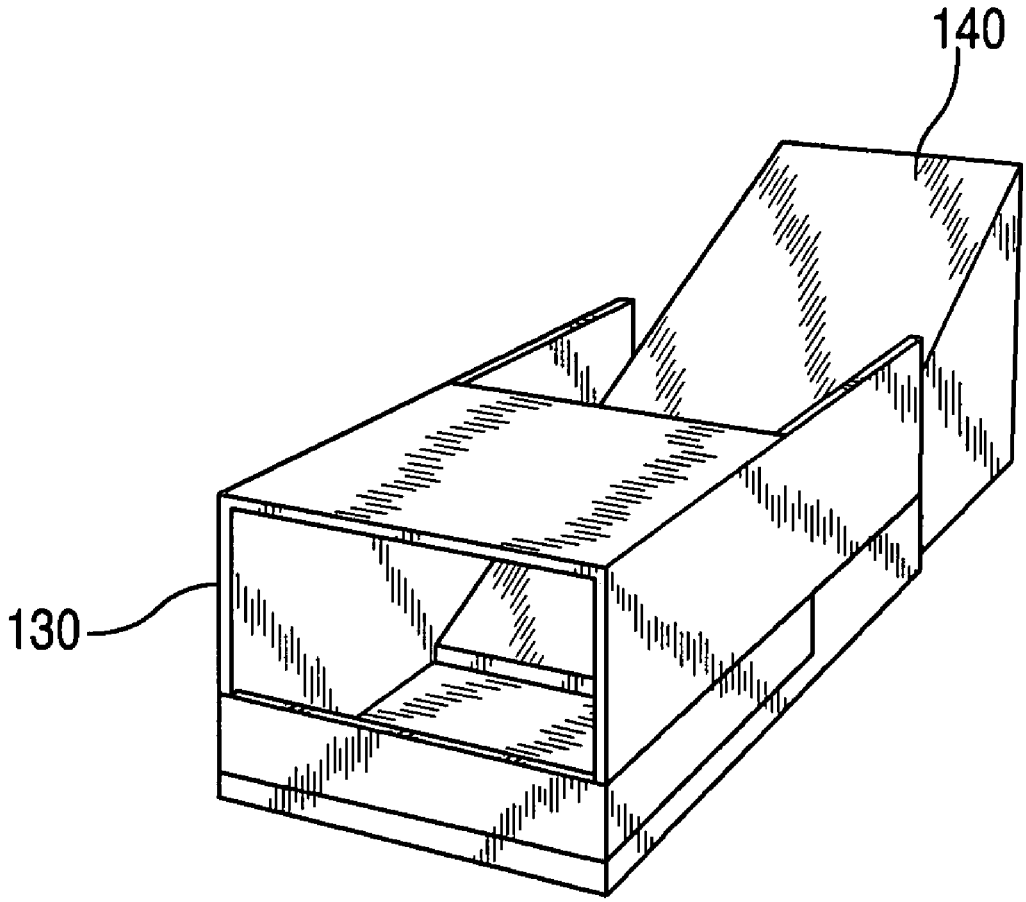
FIG. 7 is a perspective view of a Picking Portal Assembly with the Inside Wedge Assembly inserted therein.
Figure 7A:
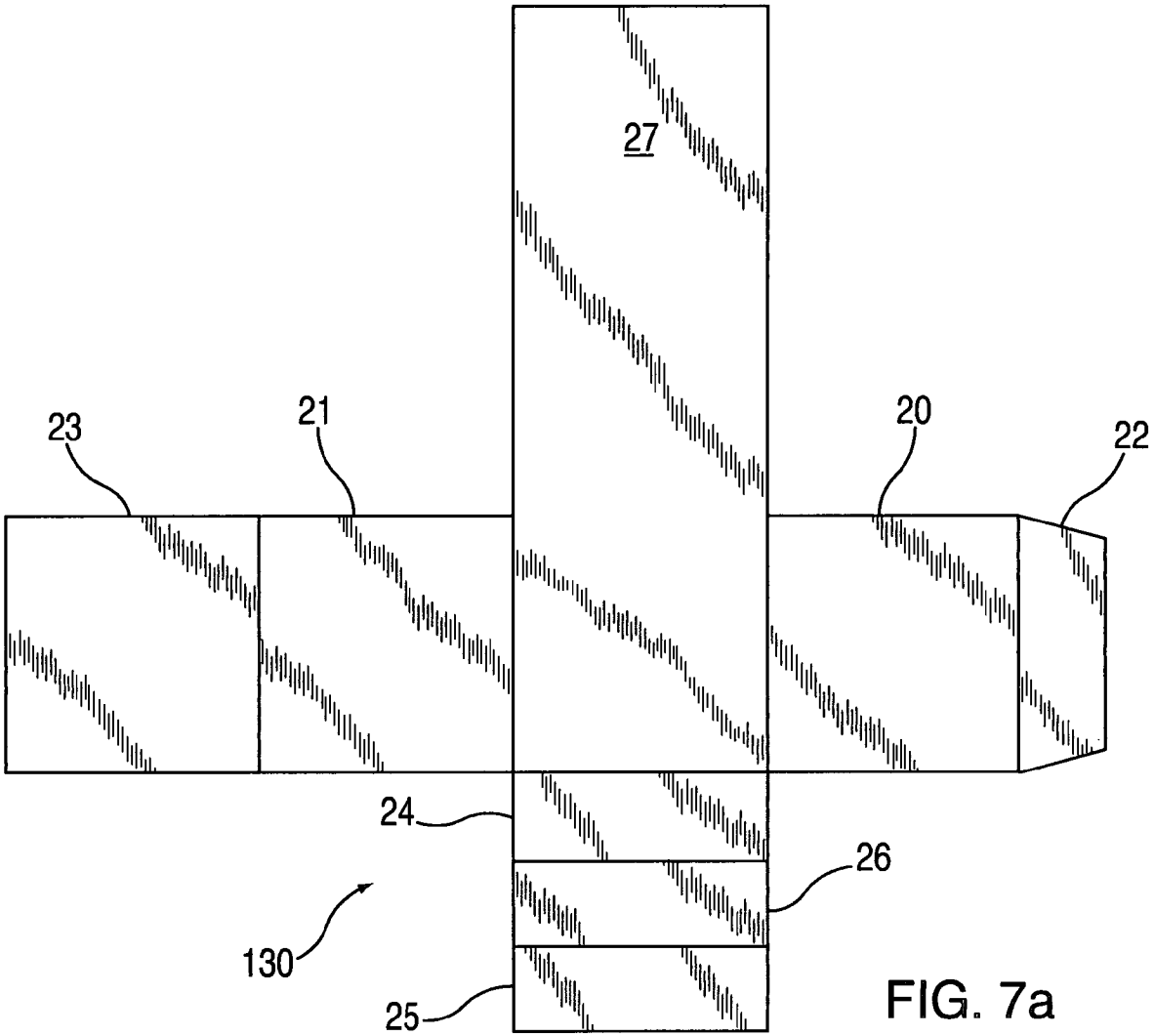
FIG. 7*a* shows the assembly layout blank from which the Picking Portal Assembly is made.

The Main Hopper Assembly 100 of the Self-Adjusting Volume Display and Dispensing System is illustrated in FIG. 4*a*. The Main Hooper Assembly 100 is assembled in the form of a rectangular enclosure, comprising Front and Rear Walls 1 and 2 and Left and Right Side Walls 3 and 4 integral therewith. The Front Wall 1 is open at the bottom. This opening is called the Main Hopper Assembly Discharge Opening 8 through which the Picking Portal Assembly illustrated in FIGS. 7 and 7*a* is inserted. The Rear Wall 2 has a flap 7 serving to secure the front and sidewalls of the assembly to form a rectangular box-like structure when so folded. The Left and Right side Walls 3 and 4 have Flaps 5 and 6 to be folded inwardly at right angles to form the bottom of the assembly and to secure the assembly to maintain its integrity in a rectangular box-like shape. Permanent bonding of the walls to the flaps is accomplished by use of an adhesive, tape, or other suitable fasteners. The top of the box shaped assembly formed by folding the walls and flaps as described is open for insertion of other components.

Figure 5:
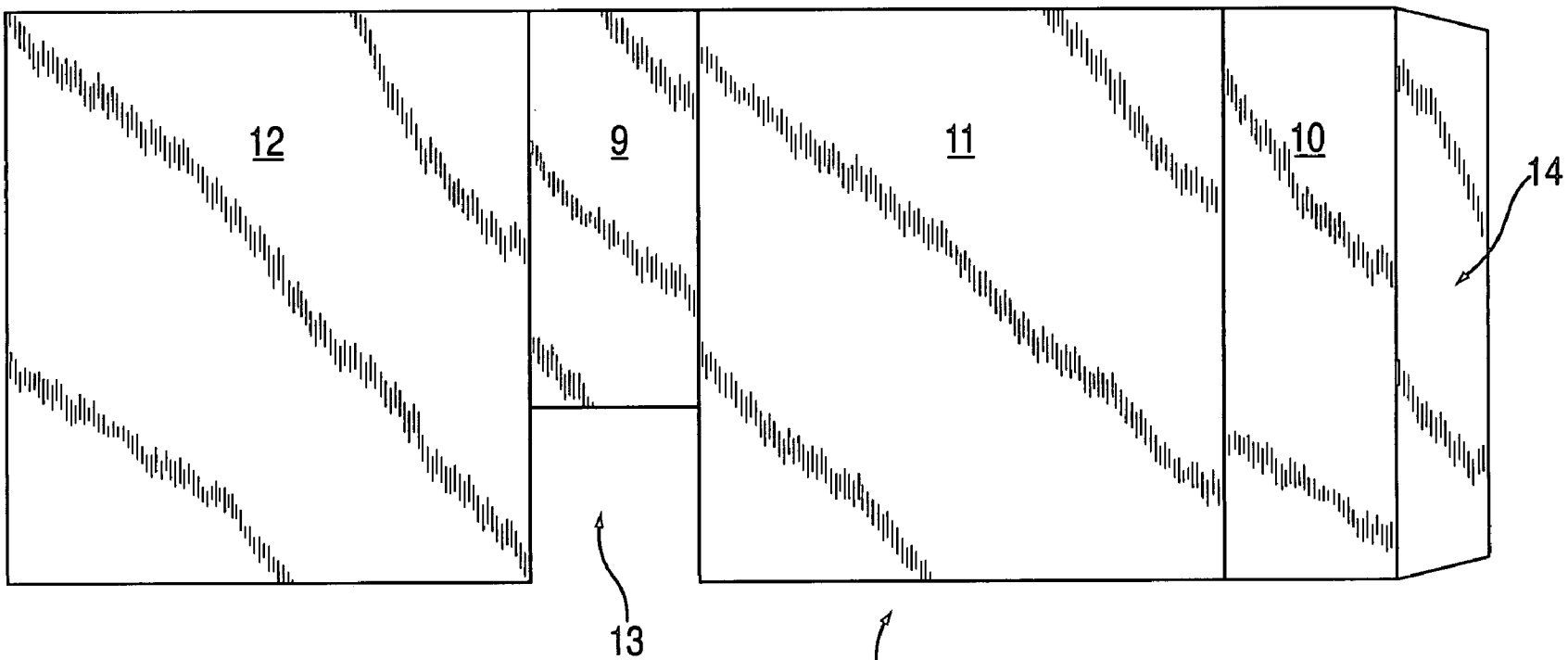
FIG. 5 shows an assembly layout blank from which the Main Hopper Liner Assembly is made.

The Main Hopper Assembly 100 is adapted to slidingly receive through its top opening the Main Hopper Liner Assembly 110 as illustrated in FIGS. 4 and 5. The Main Hooper Liner Assembly 110 provides strength to the walls of the Main Hopper Assembly 100. The Main Hopper Liner Assembly 110 is comprised of Front and Rear Walls 9 and 10 and Left and Right Side Walls 11 and 12 integral therewith. The Main Hopper Liner Assembly Discharge Opening 13 is located at the bottom of the Front Wall 9, which matches the opening in the Main Hopper Assembly 8, once inserted therein. The Rear Wall 10 has Flap 14, when folded inwardly to contact the Right side of the Main hopper Liner Wall 12, is used to secure the assembly forming an open top and open bottom vessel. In final assembly, the Rear Wall flap 14 will be permanently affixed to the Right Side of the Main Hopper Liner Wall by an adhesive, tape, or other suitable fastening means.

Figure 6:
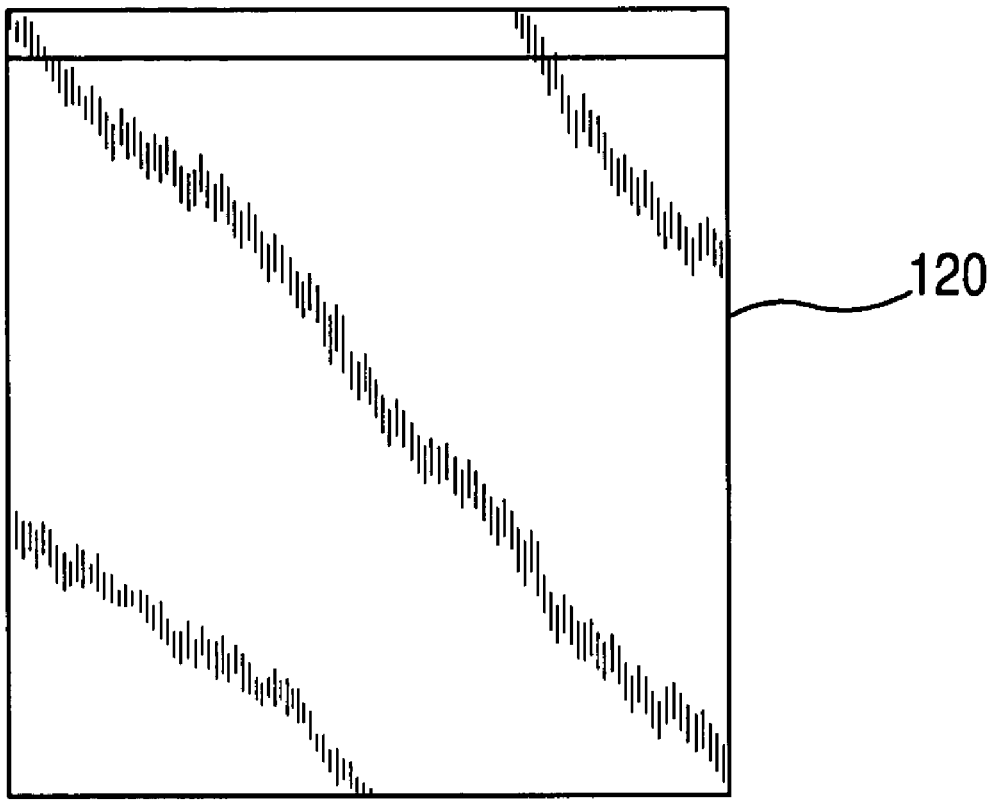
FIG. 6 is a Right Side view of a stand-alone Self-Adjusting Volume Control Assembly.
Figure 6A:
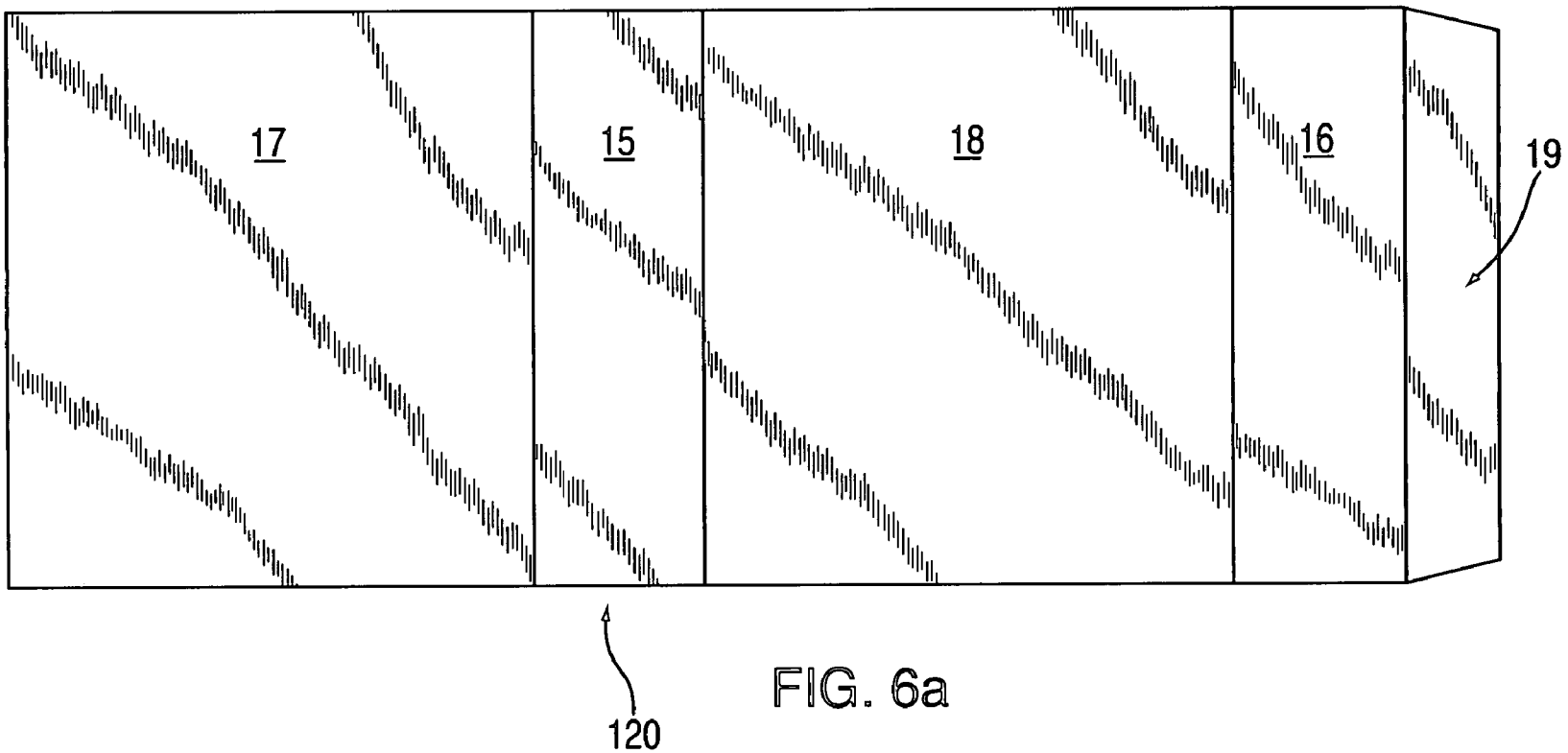
FIG. 6*a* shows the assembly layout blank from which the Self-Adjusting Volume Control Assembly is made.

FIG. 6 illustrates a Self-Adjusting Volume Control Hopper Assembly 120. The Self-Adjusting Volume Control Hopper Assembly 120 is slidingly inserted in the Main Hopper Liner Assembly 110 and engaged therein. This component 120 is another rectangular shaped enclosure with an open top and bottom and is vertically inserted downwardly into the Main Hopper Liner Assembly 110, which is then in turn inserted into the Main Hopper Assembly 100. The Self-Adjusting Volume Control Hopper Assembly 120 layout blank is shown in FIG. 6*a* with the Right Side Volume Control Wall 17 and the Left Side Volume Control Assembly Wall 18 engaged with the right and left sides of the Front Wall. In constructing the assembly, the Right and Left Volume Control Walls 17 and 18 are folded rearward on their fold lines common with the Front Wall 15. Attached to the right side of the Left Side Volume Control Wall 18 is the Rear Wall 16 that has on its rightmost side a Volume Control Assembly Flap 19. Completing the construction involves folding the Rear Wall 16 toward the Right side Volume Control Wall 17 and securing it to that component. The rectangular shaped assembly is secured by folding the Volume Control Assembly flap 19 forward to contact the Right Side Volume Control Wall 17. The assembly of component 120 is bonded by an adhesive, tape, or other suitable fasteners.

FIGS. 7 and 7*a* illustrate an assembly layout blank of the Picking Portal Assembly 130. The bottom 27 of the Picking Portal Assembly is rectangular in shape and is constructed and sized to be inserted into the Main Hopper Assembly 100 through the Discharge Openings 8 and 13 of the Main Hopper Assembly 100. As viewed from the top, the bottom wall of component 130 has a Left Panel 20 and a Right Panel 21 contiguously joined therewith. The Right Panel 21 has a Top Panel 23, attached thereto on its left side.

Figure 7B:
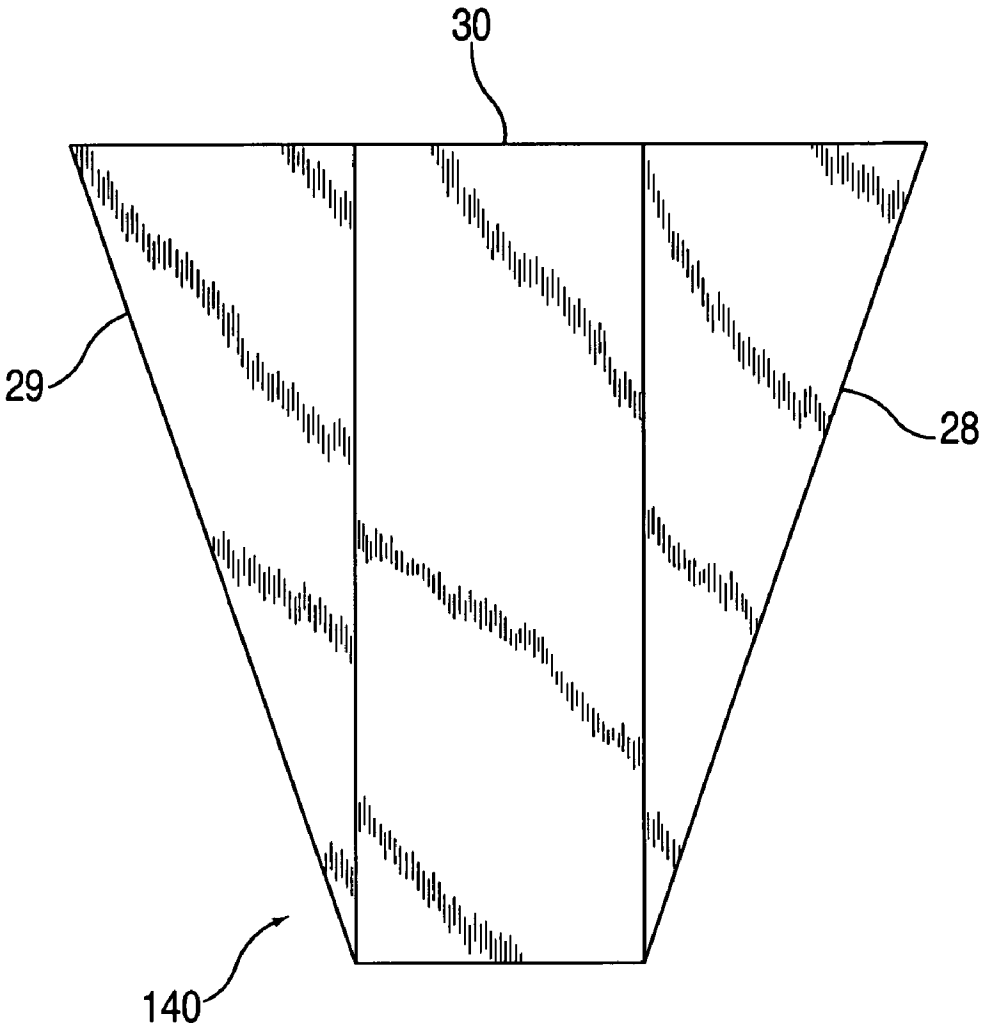
FIG. 7*b* shows the assembly layout blank from which the Inside Wedge Assembly is made.

Three small flaps 24, 25, and 26 are attached to the front of the bottom of the Picking Portal Assembly 130. The three flaps 24, 25 and 26 form a rectangular box-like structure when the first flap 24 is folded up at a right angle, the second flap 26, contiguous to it, is folded backward at a right angle and the third flap 25, contiguous to the second panel, is folded down at a right angle to form an enclosure. The Right and Left Panels 20 and 21 are folded upward along their fold lines and the Top panel 23 is folded inward along the fold lines with the bottom to form another box-like structure. The Left Panel Flap 22 is used to secure the box-like structure together when folded inward and joined with the Top Panel 23. Permanent bonding is accomplished by the use of adhesives, tape, or other suitable fasteners. The Picking Portal Assembly 130 is then inserted into the Main Hopper Assembly 100 through the Discharge Opening 8 of the Main Hopper Assembly 100. Thereafter, it slides rearwardly under the bottom front of the Inside Wedge Assembly 140 as illustrated in FIG. 7*b*.

Constructed to be placed in the bottom portion of the Picking Portal Assembly 130, is an inclined ramp, the Inside Wedge Assembly 140. The assembly layout blank is trapezoidal in shape and provides a platform that extends from the inside rear of the Main Hopper Assembly 100 to the mid point of the Picking Portal Assembly 130 which is inserted in the Main Hopper Assembly Discharge Opening 8 and the Main Hopper Liner Discharge Opening 13. As shown in FIG. 7*b*, the Top Panel of the Inside Wedge Assembly layout blank 30 is rectangular in shape with the Left and Right Panels 28 and 29 attached thereto. In construction of this member, both the Left and the Right Panels are folded downward, where they will rest from the bottom mid-point of the Picking Portal Assembly 130 to the bottom rear of the Main Hopper Assembly 100.

Figure 9:
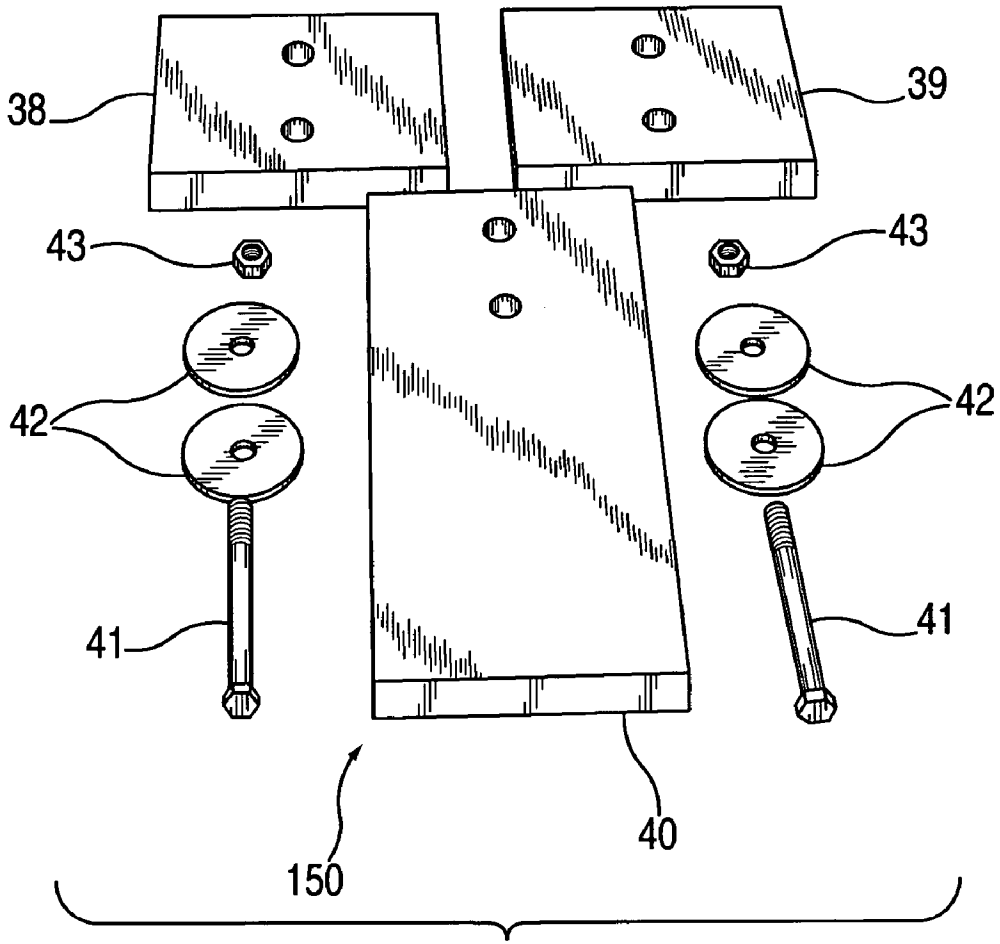
FIG. 9 shows a perspective view of the Hanger Assembly viewed from the left-hand side of the Main Hopper Attachment Assembly FIG. 10 and attached to the rear thereto.
Figure 9A:
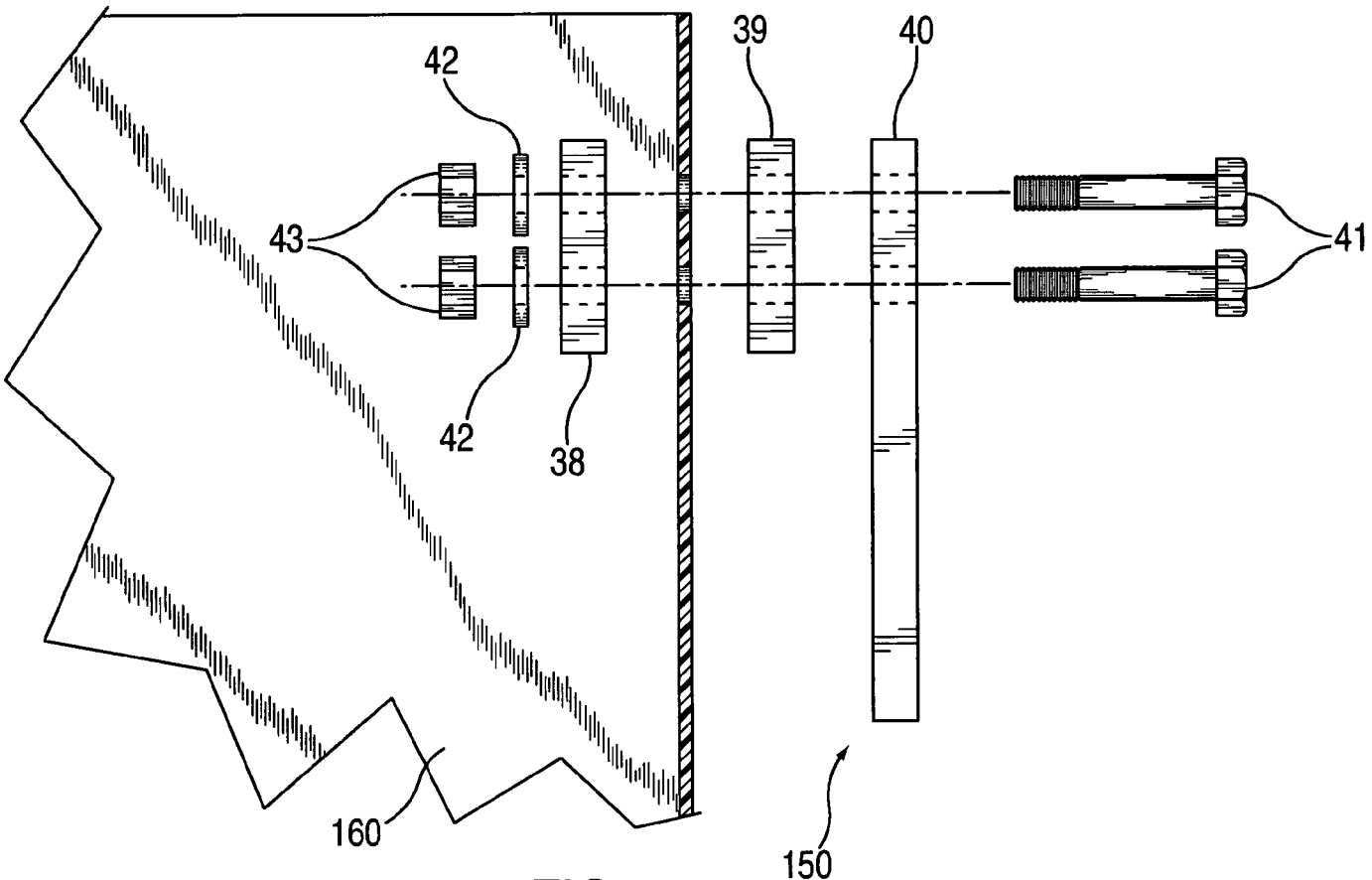
FIG. 9*a* is an assembly view illustrating the attachment of the hanger assembly to the Main Hopper Attachment Assembly.

FIG. 9 and FIG. 9*a* illustrate a Hanger Assembly 150. The Hanger Assembly 150 is used to secure a Main Hopper Attachment Assembly 160 to the Main Hopper Assembly 100. The components of the Hanger Assembly 150 are Front and Rear Spacer Blocks 38 and 39 and a Hanger Assembly Securing Bracket 40. The Inside Spacer is mounted on the inside upper portion of the Main Hopper Attachment Assembly Rear Wall 22 shown in FIG. 10. The Rear Spacer Block 39 is correspondingly mounted on the rear upper portion of the Main Hopper Assembly Attachment Rear Wall 22. The Securing Bracket 40 is correspondingly placed in contact with the Rear Spacer Block 39 extending downward. This assemblage is held together with assorted hardware consisting of Bolts 41, Washers 42, and Nuts 43.

Figure 11:
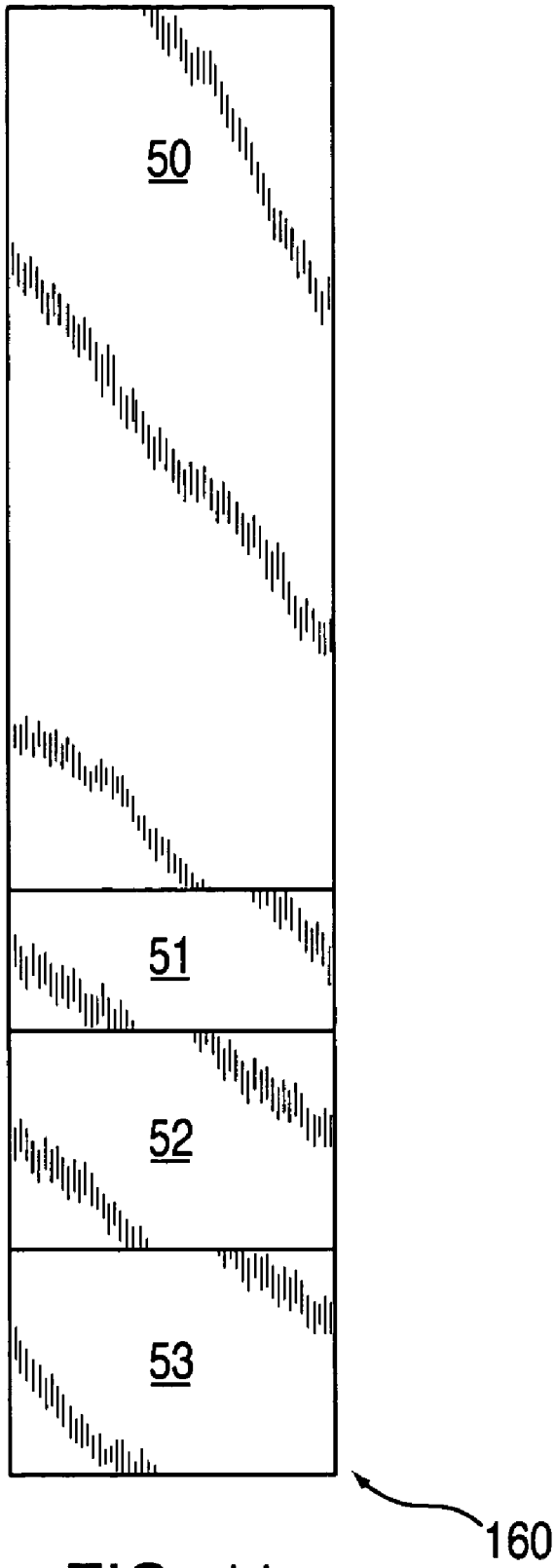
FIG. 11 illustrates an assembly layout blank of the Main Hopper Attachment Wedge Assembly.

FIG. 11 illustrates an assembly layout blank of the Main Hopper Attachment Wedge Assembly 160. The Main Hopper Attachment Wedge Assembly 160 consists of a long, rectangular Face Panel 50 with three consecutively numbered Flaps 51, 52, and 53 attached to the lower end of the wedge. Flap 51, intimately attaches to the rectangular Face Plate 50 and is folded rearward along its fold lines. Flap 52, attached to Flap 50, is folded along its fold lines upward and Flap 53 is folded forward and down along its fold lines to the intersection of the rectangular Face Plate 50 and Flap 51 folding line to form a triangular enclosure. The Attachment Wedge Assembly 160 is inserted at the top of the Main Hopper Attachment Assembly 150 with the triangular enclosure at the bottom facing rearward. The wedge, when in position, serves to urge merchandise forward to the Main Hopper Attachment Assembly Discharge Opening 49 located in the face plane of the Main Hopper Assembly 100.

Figure 8:
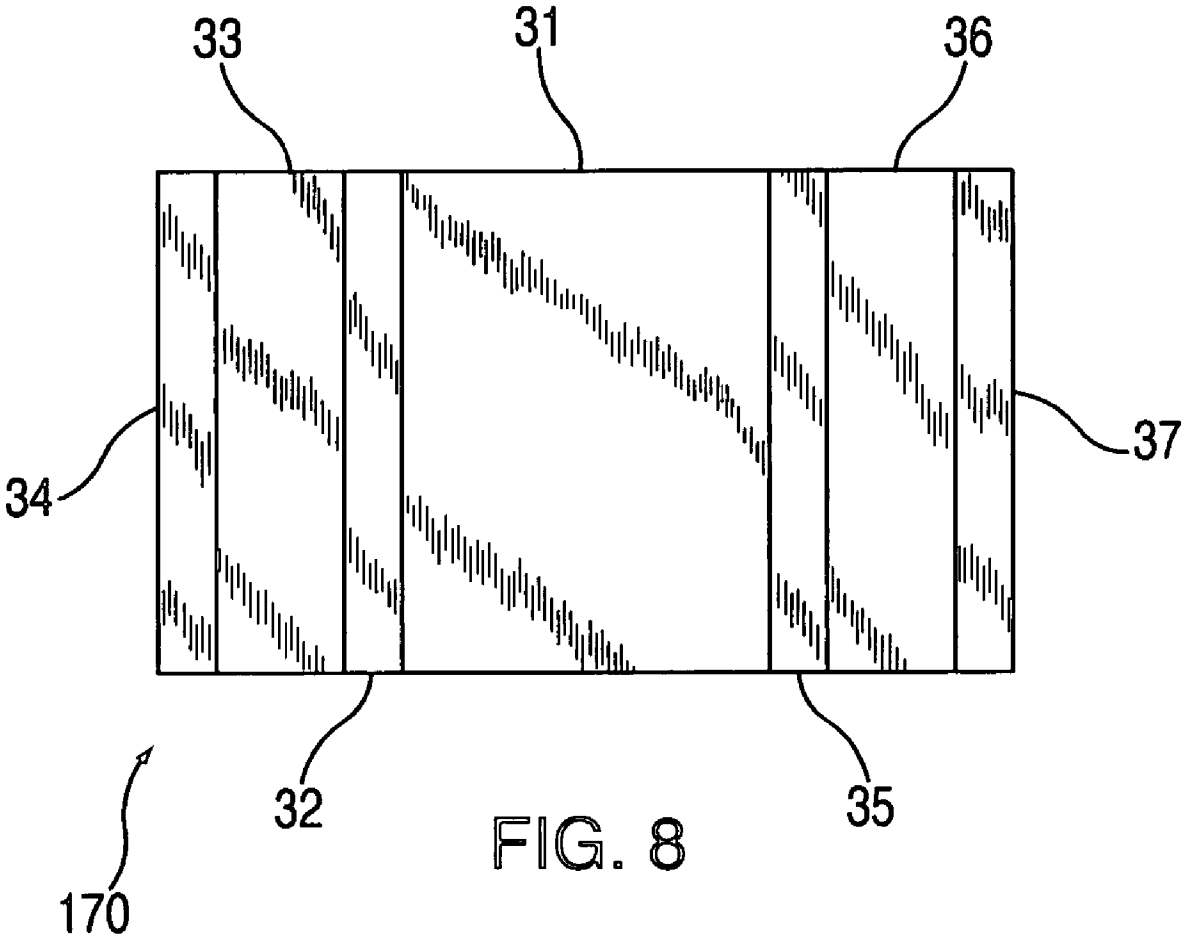
FIG. 8 shows an assembly layout blank from which the Rail Assembly is made.

A Rail Assembly 170 that is used to attach the Main Hopper Attachment Assembly 160 to the front of the Main Hopper, is shown in FIG. 8 and serves as a spacer for the insertion of the Hanger Assembly 150. The Front Panel Rail Assembly is rectangular in shape, having three contiguously joined Right Flaps 32, 33, and 34 and three contiguously joined Left Flaps 35, 36, and 36. The Rail Assembly 170 is inserted from a vertical position between the Main Hopper Liner Assembly 100 and the Self-Adjusting Volume Control Assembly 120. It is constructed by folding rearward both Right and Left Flaps 32 and 35 that are immediately contiguous to the right and left sides of the Rail Assembly Front Wall 31. The Right and Left Flaps 36 and 33 immediately contiguous to Flaps 32 and 35 are folded inward and Flaps 34 and 37 are folded forward to form yet another box-like structure on each side of the Front Panel 31. The dimension of the last folds Flaps 34 and 37 determine the space necessary to insert the Hanger Assembly 150.

Figure 1:
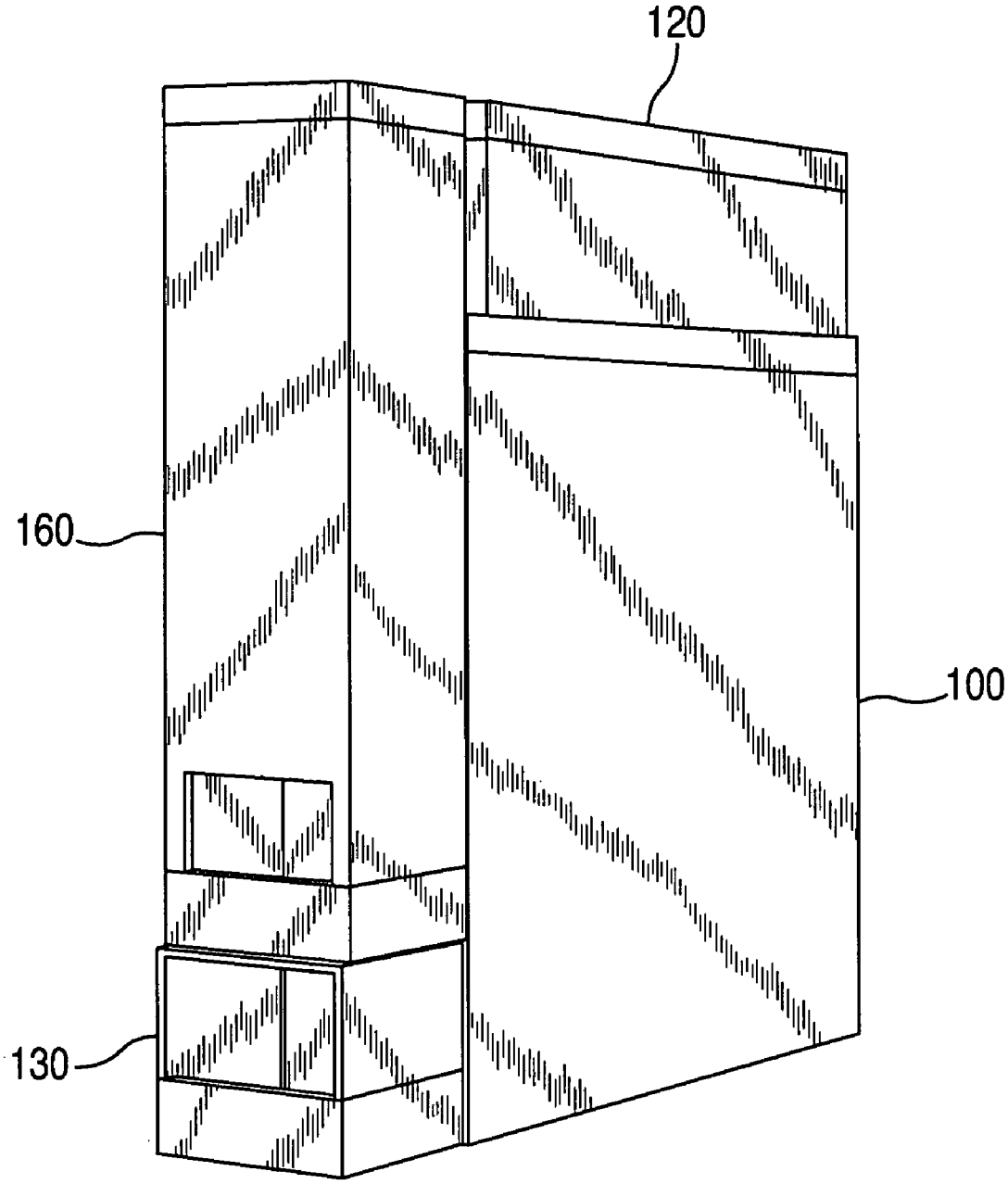
FIG. 1 is a perspective view showing the novel dispensing system of the present invention completely assembled and in an upright position.
Figure 2:
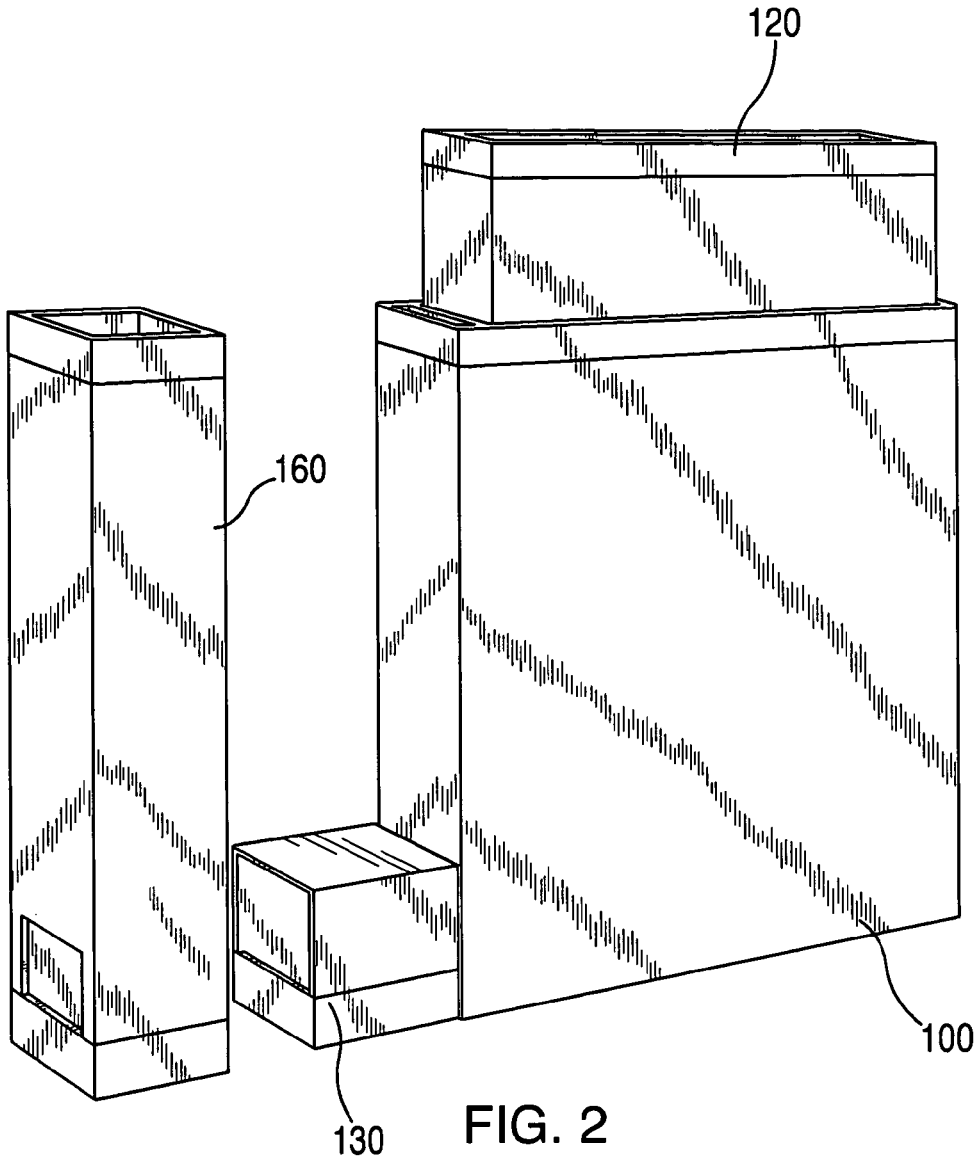
FIG. 2 is a perspective view showing the main components of a partially assembled Self-Adjusting Volume Display and Merchandise Dispensing System—the Main Hopper Assembly, the Self-Adjusting Volume Control Assembly, the Picking Portal Assembly, and the Main Hopper Attachment Assembly. Self-Adjusting Volume Control Assembly is shown in the collapsed position showing a reduced quantity of merchandise stored in the main hopper.
Figure 3:
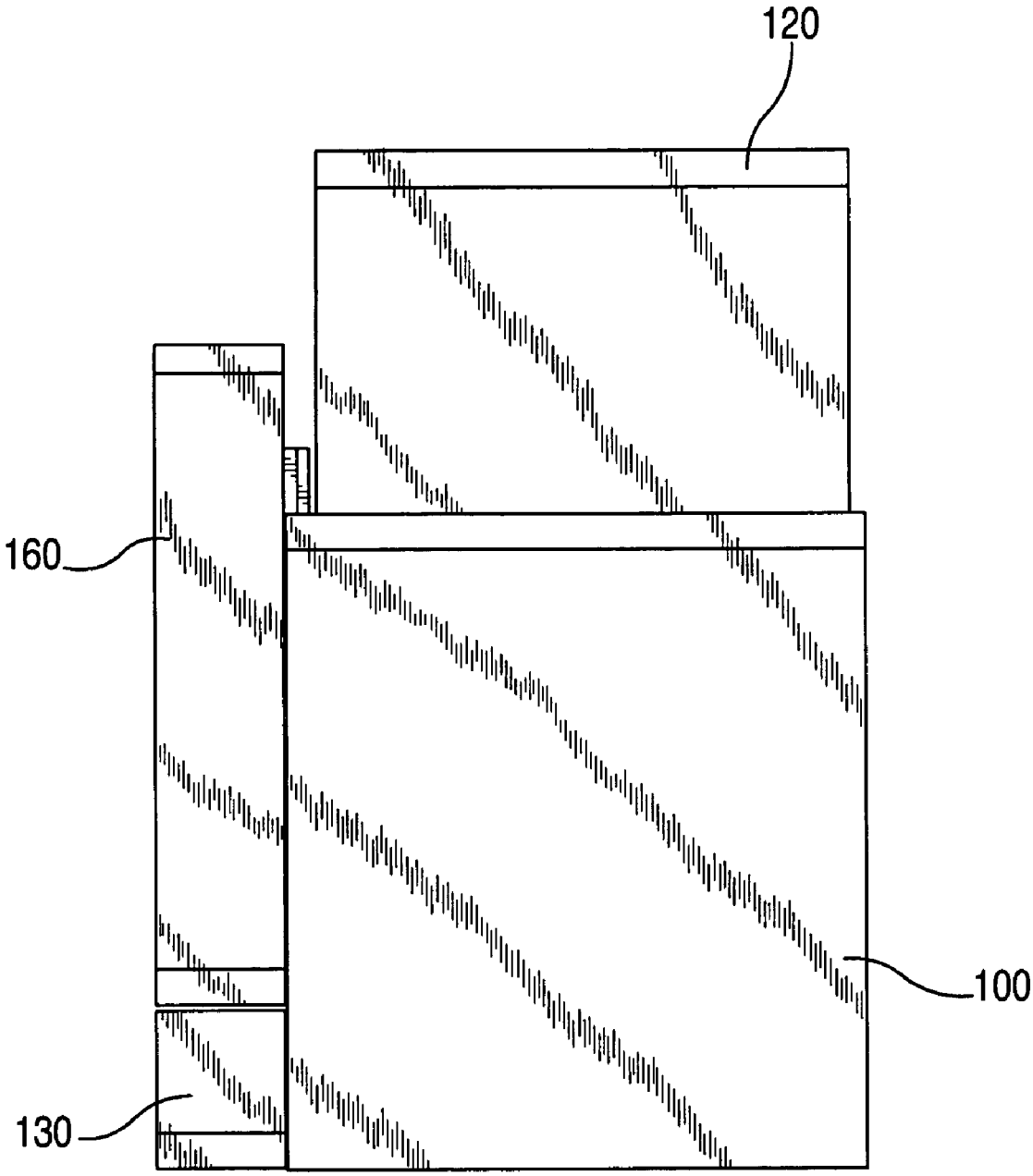
FIG. 3 is a right side view of a completely assembled Self-Adjusting Volume Display and Merchandising Dispensing System with the Self-Adjusting Volume Control Assembly in the raised position indicating a large quantity of merchandise therein.
Figure 10:
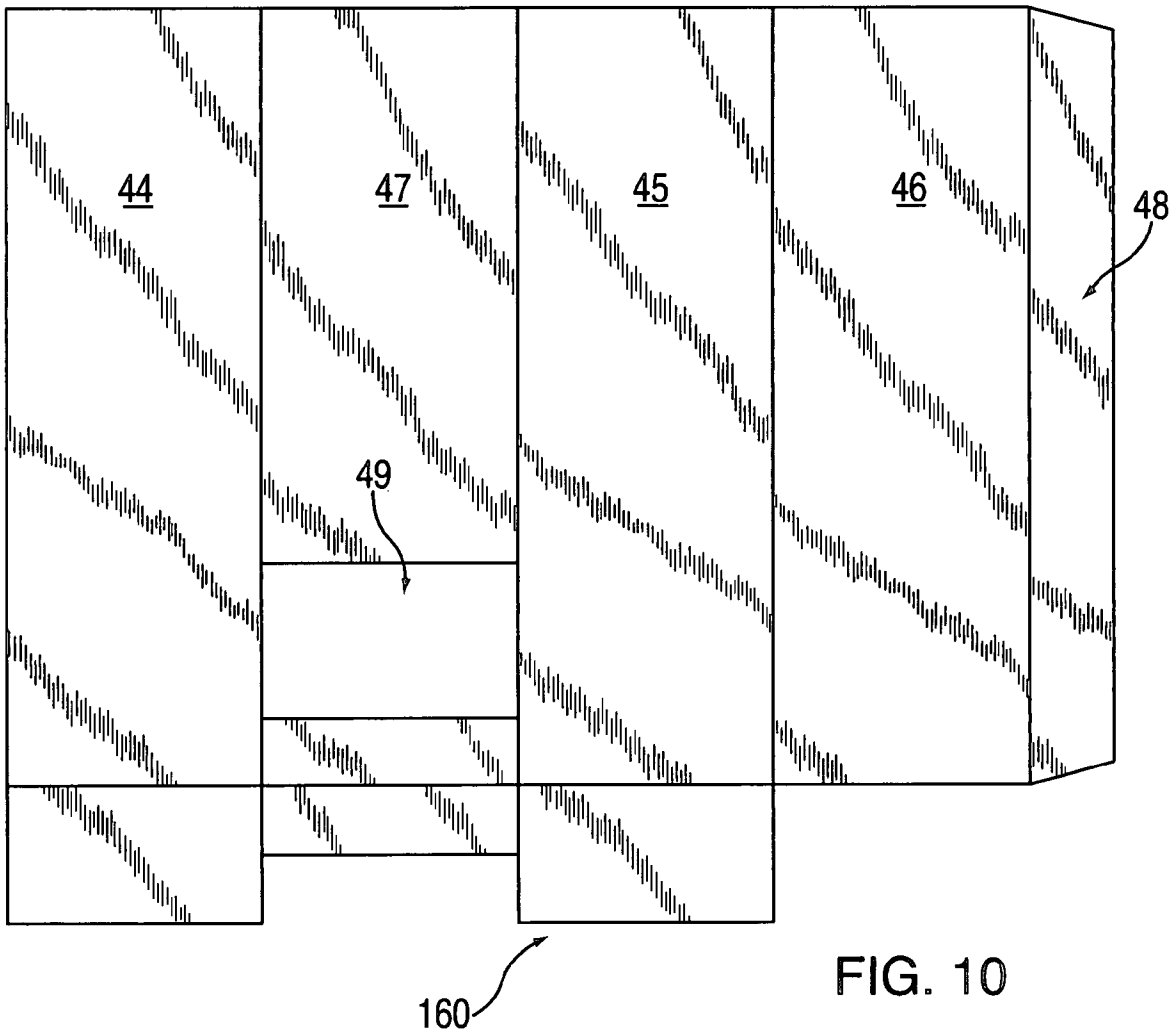
FIG. 10 shows an assembly layout blank form which the Main Hopper Attachment Wedge is made.

The Main Hopper Attachment Assembly 160 is mounted on top of the Picking Portal Assembly 130 that extends from the front face of the Main Hopper Assembly 100. It is secured to the latter by the Hanger Assembly 150. A perspective view of the Main hopper Attachment Assembly 160 as shown in FIGS. 1, 2, and 3, is also a rectangular shaped component giving the Self-Adjusting Volume Display and Merchandise Dispensing System an additional face or Discharge Opening from which to dispense merchandise. The Main Hopper Attachment Assembly 160 layout blank is shown in FIG. 10. For construction of the assembly, fold at right angles both the Right and Left Walls 44 and 45 rearward along fold lines contiguous with Front Wall 47. Fold the Rear Wall 46 toward the Right Wall 44. Fold Securing Flap 48 forward at a right angle along its fold lines with the Rear Wall 46 toward the front of the assembly and secure to the Right Wall 44. The unit is bonded together with adhesives, tape, or other suitable fasteners.

The present invention, a display and merchandise dispenser, provides an embodiment that is constructed of materials such as corrugated cardboard or paperboard, but is also well suited for fabrication from more permanent materials such as plastic. The invention can be used in a commercial or an industrial setting where product and merchandise are manually extracted from multiple picking portals by customers, workers, or order pickers to fill their respective orders. Taking advantage of the unused space above the dispensers, seldom used by available systems and methods, the present invention increases the readily available volume of merchandise stored for dispensing while reducing the walking distance of the customer or order pickers required to extract the merchandise. The invention also puts the merchandise within easy reach of customers or order pickers without requiring ladders or stools. As the order picker or customer removes the exposed merchandise from the picking portal, other merchandise is urged forward by a wedge assembly on the floor of the hoppers such that additional stored merchandise becomes visible to the individual removing the merchandise.

Those of ordinary skill in the art will recognize the embodiments that describe merely illustrate the present invention and that many modifications may be made thereto without departing from the sport or scope of the present invention as set forth in the claims.

What is claimed is:

1. An apparatus for efficiently storing items for retrieval and distribution so as to reduce storage space and increase retrieval efficiency comprising:

a. A plurality of uniformly shaped containers adapted to be used fro storage of items wherein the containers are generally rectangular in a horizontal cross-section and comprise a front wall, a back wall and two side walls, and are generally rectangular in a vertical cross-section and comprise an opening in the top of the container through which the items will be placed into the container and an opening in the bottom of the container through which the items will be removed after being dispensed through the container by gravity; and b. A plurality of racks on which the plurality of containers will be aligned in a uniform fashion so as to minimize the area required to contain the plurality of containers on the plurality of racks.

2. The apparatus according to claim 1 wherein the containers further comprise a telescoping insert of rectangular cross-section adapted to be slidingly received through the opening in the top of the container such that the container can be extended in the vertical direction to increase storage capacity of the container.

3. The apparatus according to claim 2 wherein the opening in the bottom of the containers further comprises a rectangular box-shape that protrudes from the front surface of the containers whereby a container of smaller volume than each of the plurality of uniformly shaped containers comprising a generally rectangular cross-section can be stacked on top of the protruding rectangular box and the smaller storage container further comprises an opening at its top for the insertion of items to be stored and an opening at its bottom for retrieval of the stored items.

4. A method for efficiently storing items for retrieval and distribution so as to reduce storage space and increase retrieval efficiency comprising the steps of:

a. Providing a plurality of uniformly shaped containers adapted to be used for storage of items wherein the containers are generally rectangular in a horizontal cross-section and comprise a front wall, a back wall, and two side walls, and are generally rectangular in a vertical cross-section and comprise an opening in the top of the container through which the items will be placed into the container through which the items will be removed after being dispensed through the container by gravity;

b. Providing a plurality of racks on which the plurality of containers will be aligned in a uniform fashion; and c. Arranging the plurality of containers on the plurality of racks so as to minimize the area required to contain the plurality of containers on the plurality of racks.

5. The method according to claim 4 wherein the containers further comprise a telescoping insert of rectangular cross-section adapted to be slidingly received through the opening in the top of the container such that the container can be extended in the vertical direction to increase storage capacity of the container.

6. The method according to claim 5 wherein the opening in the bottom of the containers further comprises a rectangular box-shape that protrudes from the front surface of the containers whereby a container of smaller volume than each of the plurality of uniformly shaped containers comprising a generally rectangular cross-section can be stacked on top of the protruding rectangular box and the smaller storage container further comprises an opening at its top for the insertion of items to be stored and an opening at its bottom for retrieval of the stored items.

7. An efficient method for fulfilling customer orders for stored items in a mail order warehouse comprising the steps of:

a. Providing a plurality of uniformly shaped containers adapted to be used for storage of items wherein the containers are generally rectangular in a horizontal cross-section and comprise a front wall, a back wall, and two side walls and are generally rectangular in a vertical cross-section and comprise an opening in the top of the container through which the items will be placed into the container and an opening in the bottom of the container through which the items will be removed after being dispensed through the container by gravity;

b. Providing a plurality of racks on which the plurality of containers will be aligned in a uniform fashion so as to minimize the area required to contain the plurality of containers on the plurality of racks; and c. Arranging the plurality of containers on the plurality of racks to minimize the distance between the plurality of containers so as to decrease the time it takes for a person to locate stored items to fulfill customer orders.

8. A method for efficiently storing items in a retail store for display and dispensing to customers so as to reduce storage space and increase accessibility for the customers comprising the steps of:

a. Providing a plurality of uniformly shaped containers adapted to be used for storage of items wherein the containers are generally rectangular in a horizontal cross-section and comprise a front wall, a back wall and two side walls, and are generally rectangular in a vertical cross-section and comprise an opening in the top of the container through which the items will be placed into the container and an opening in the bottom of the container through which the items will be removed after being dispensed through the container by gravity;

b. Providing a plurality of racks on which the plurality of containers will be aligned in a uniform fashion; and c. Arranging the plurality of containers on the plurality of racks so as to minimize the area required to contain the plurality of containers on the plurality of racks.

9. The method according to claim 8 wherein the opening in the bottom of the containers further comprises a rectangular box-shape that protrudes from the front surface of the containers whereby a container of smaller volume than each of the plurality of uniformly shaped containers comprising a generally rectangular cross-section can be stacked on top of the protruding rectangular box and the smaller storage container further comprises an opening at its top for the insertion of items to be stored and an opening at its bottom for retrieval of the stored items.

10. A method for efficiently storing items in a retail store for display and dispensing to customers so as to reduce storage space and increase accessibility for the customers comprising the steps of:

a) Providing a plurality of uniformly shaped containers adapted to be used for storage of items wherein the containers are generally rectangular in a horizontal cross-section and generally rectangular in a vertical cross-section and comprise an opening in the top of the container through which the items will be placed into the container and an opening in the bottom of the container through which the items will be removed after being dispensed through the container by gravity;

b) Providing a plurality of racks on which the plurality of containers will be aligned in a uniform fashion; and c) Arranging the plurality of containers on the plurality of racks so as to minimize the area required to contain the plurality of containers on the plurality of racks.

11. The method according to claim 10 wherein the containers further comprise a telescoping insert of rectangular cross-section adapted to be slidingly received through the opening in the top of the container such that the container can be extended in the vertical direction to increase storage capacity of the container.

12. The method according to claim 11 wherein the opening in the bottom of the containers further comprises a rectangular box-shape that protrudes from the front surface of the containers whereby a container of smaller volume than each of the plurality of uniformly shaped containers comprising a generally rectangular cross-section can be stacked on top of the protruding rectangular box and the smaller storage container further comprises an opening at its top for the insertion of items to be stored and an opening at its bottom for retrieval of the stored items.

* * * * *